United States Patent [19]

Harala

[11] Patent Number: 4,755,338

[45] Date of Patent: Jul. 5, 1988

[54] METHOD AND SLIDE-CASTING MACHINE FOR THE CASTING OF HOLLOW PRE-CAST UNITS OF CONCRETE

[75] Inventor: Olli E. J. Harala, Toijala, Finland

[73] Assignee: Oy Partek AB, Toijala, Finland

[21] Appl. No.: 946,620

[22] Filed: Dec. 29, 1986

Related U.S. Application Data

[63] Continuation of Ser. No. 693,156, Jan. 22, 1985, abandoned.

[30] Foreign Application Priority Data

Jan. 19, 1984 [FI] Finland ..... 840217

[51] Int. Cl.[4] ..... B28B 1/10

[52] U.S. Cl. ..... 264/209.2; 264/70; 264/177.11; 264/211.11; 264/312; 264/313; 425/64; 425/262; 425/427; 425/428; 425/456

[58] Field of Search ..... 264/70, 211.11, 312, 264/313, 209.2, 177.11; 425/64, 262, 425, 426, 427, 428, 456

[56] References Cited

U.S. PATENT DOCUMENTS

| | | | |
|---|---|---|---|
| 1,573,566 | 2/1926 | Nichols . | |
| 1,937,898 | 12/1933 | La Due | 264/312 |
| 3,091,013 | 5/1963 | Robinson | 425/59 |
| 3,193,901 | 7/1965 | Lee et al. | 425/64 |
| 3,276,091 | 10/1966 | Pausch | 425/262 |
| 3,810,441 | 5/1974 | Padgett et al. | 425/426 |
| 4,046,848 | 12/1977 | Putti | 264/70 |
| 4,202,658 | 5/1980 | Ahonen | 425/64 |
| 4,539,165 | 9/1985 | Paakkinen | 264/23 |
| 4,545,946 | 10/1985 | Sarja | 264/70 |
| 4,568,503 | 2/1986 | Laine et al. | 264/70 |
| 4,574,064 | 3/1986 | Paakkinen | 264/70 |
| 4,608,216 | 8/1986 | Barsk | 264/70 |
| 4,668,447 | 5/1987 | Paakkinen | 264/70 |

FOREIGN PATENT DOCUMENTS

| | | |
|---|---|---|
| 0079172 | 5/1983 | European Pat. Off. . |
| 0079173 | 5/1983 | European Pat. Off. . |
| 1135356 | 8/1962 | Fed. Rep. of Germany . |
| 854725 | 8/1981 | U.S.S.R. . |
| 876428 | 10/1981 | U.S.S.R. . |
| 947362 | 10/1982 | U.S.S.R. . |
| 1078011 | 3/1984 | U.S.S.R. . |
| 1096362 | 6/1984 | U.S.S.R. . |

*Primary Examiner*—Jan H. Silbaugh
*Assistant Examiner*—Mary Lynn Fertig
*Attorney, Agent, or Firm*—Burns, Doane, Swecker & Mathis

[57] ABSTRACT

Method and slide-casting machine for the casting of hollow precast units of concrete by means of slide-casting. Concrete mix is extruded onto a base by using one or several shaping members that form a cavity and the mix is compacted by moving the shaping members. The outer face of the shaping members is provided with a projection or projections, or a projection or projections are formed at the outer face of the shaping members from time to time. The locations of the projections are changed to the longitudinal axis of the shaping members. Thereby the shaping members produce forces compressing the mix in the surrounding mix, i.e. forces that compact the concrete. It is possible to use shaping members in which the shape of the mantle portion can be changed so that the distances of the different points at the outer face of the shaping member from the longitudinal axis of the shaping member vary. The shape of the mantle portion of the shaping member can be changed, for example, by displacing a moving member placed inside the mantle portion.

11 Claims, 8 Drawing Sheets

METHOD AND SLIDE-CASTING MACHINE FOR THE CASTING OF HOLLOW PRE-CAST UNITS OF CONCRETE

This application is a continuation of application Ser. No. 693,156, filed Jan. 22, 1985 now abandoned.

BACKGROUND AND SUMMARY OF THE INVENTION

The present invention is concerned with a method for the casting of hollow precast units of concrete by means of slide-casting, wherein the concrete mix is extruded onto a base by using one or several shaping members that form a cavity and the mix is compacted by moving the shaping members. The invention is also concerned with a slide-casting machine for the casting of hollow precast units of concrete, the said apparatus comprising a deck plate, side walls, one or several feeding members for feeding the concrete mix, as well as one or several displacement shaping members for forming the cavities. The invention is suitable in particular for the production of prestressed hollow slabs. It may also be applied to the manufacture of hollow slabs of reinforced concrete.

In the prior art, several slide-casting machines for producing hollow slabs are known. These prior art machines operate on a similar principle, wherein the concrete mix is extruded in the machine by means of spiral screws. One of such solutions is described in the U.S. Pat. No. 4,046,848. The machine runs along rails placed on a base. The spiral screw is conical, the cone having a shape becoming wider towards the final end of the machine, whereby compacting of the concrete is also achieved.

As an immediate extension of the spiral screw, there is a shaping member, a so-called cavity mandrel, which is vibrated by means of a vibrator fitted inside the mandrel. The frequency of vibration is about 150 to 250 c/s. Moreover, a vibrator beam fitted in the deck part of the machine is vibrated, whereby the vibration of the cavity mandrels together with the surface vibration at the top of the machine produce the ultimate compacting of the concrete.

The cavity mandrel is followed by a so-called follower tube, whose function is to support the wall of the cavity at the final end of the machine.

Drawbacks of the cavity mandrel are the strong noise (more than 85 dBA) resulting from the high frequency of vibration, high requirement of power, and the low efficiency of the vibrating power used for the vibration.

From the Finnish patent publications Nos. 64,072 and 64,073, a method is known for compacting of concrete mix so that, instead of vibration, shearing forces are applied to the mix for the purpose of compacting the mix. The shearing forces are produced by moving two opposite walls of the mould back and forth in the same direction.

The invention provides a novel method and apparatus for producing hollow, pre-cast units of concrete that overcome the noise, power and efficiency drawbacks of the prior art slide casting machines. The method in accordance with the invention is characterized in that shaping members are used whose outer face is provided with a projection or projections, or a projection or projections are formed at the outer face of the shaping members from time to time, and the locations of the projections are changed relative the longitudinal axis of the shaping members, whereby the shaping members produce forces which compress the mix in the surrounding mix<i.e. forces that compact the concrete. The slide-casting machine in accordance with the invention is characterized in that the outer face of the shaping members is provided with a projection or projections, or a projection or projections can be formed at the said outer face.

The projections on the shaping members can be produced so that shaping members are used whose cross-sectional shape differs from a circle. Alternatively, it is possible to use shaping members in which the shape of the outer face is modified. Herein, a projection is understood as meaning any projection whatsoever that projects from the circumference of a circle in the cross-section of the shaping member or that projects from a straight line in a longitudinal section. A projection in the cross-section changes its location by circulating around the centre part of the cross-section. A projection in the longitudinal section changes its position relative the longitudinal axis by moving axially and/or radially.

When the projections on the shaping members move, the shape of the cross section and/or longitudinal section of the space surrounding the shaping member is changed. The shaping members apply shearing forces to the mix, which forces make the aggregate particles in the mix seek new positions, whereby the mix is, at the same time, compacted.

When the compacting process produced by means of the method of the present invention is compared with the prior-art vibration compacting, it can be ascertained that in vibration compacting the frequency of the movement is high whereas the amplitude is little. On the contrary, in the method of the present invention, the frequency is relatively low whereas the amplitude is larger.

Owing to improved efficiency, the compacting process produced in accordance with the present invention is considerably more efficient in relation to the compacting energy used, compared with the compacting by vibration, while the noise level is, at the same time, significantly lower.

BRIEF DESCRIPTION OF THE DRAWINGS

The invention and its details will be described in more detail in the following with reference to the attached drawings, wherein.

DETAILED DESCRIPTION OF THE PREFERRED EMBODIMENTS

Figure 1:
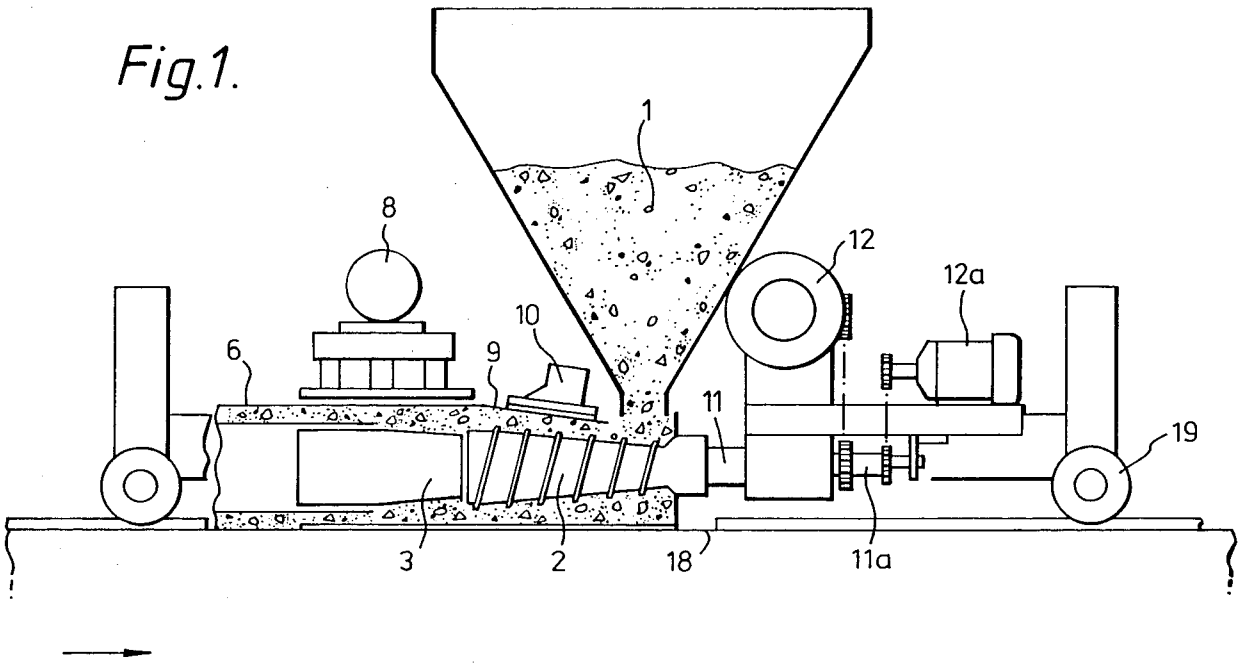
FIG. 1 is a longitudinal sectional view of a slide-casting machine in accordance with the invention.
Figure 2:
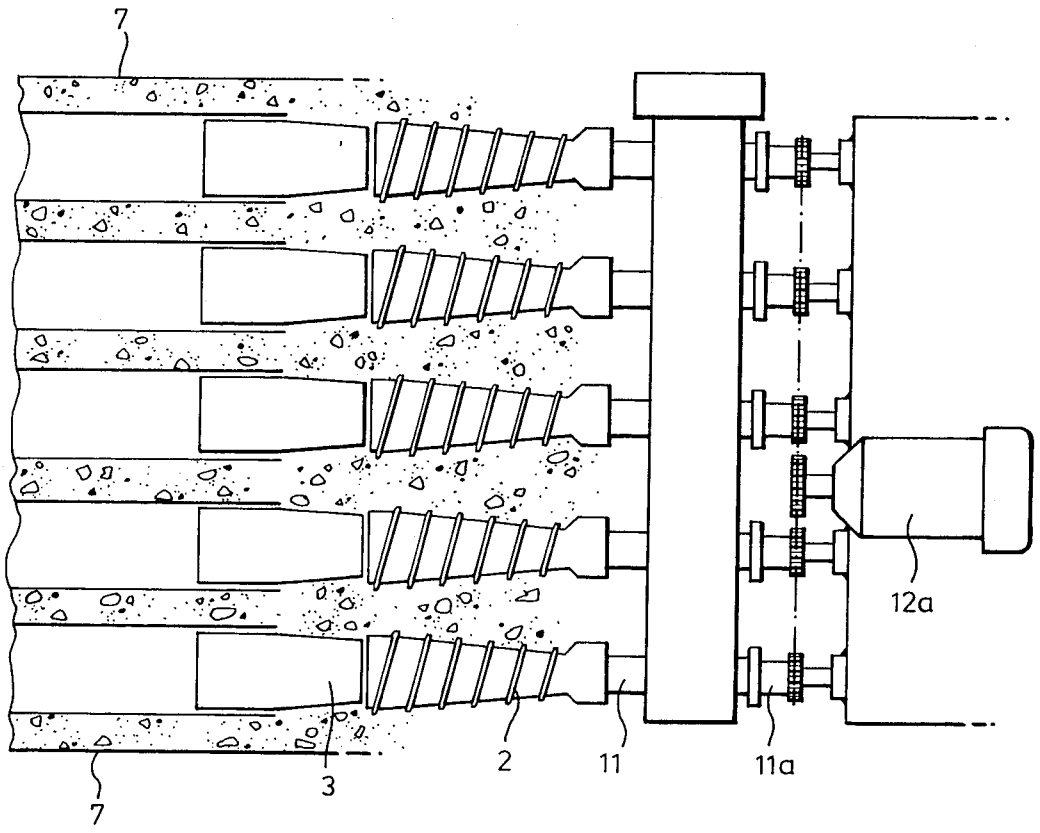
FIG. 2 is a sectional top view of the same machine.

The feeder funnel 1 joins the initial end of the slide-casting machine. Depending on the size of the slab to be cast, the machine is provided with a varying number of spiral screws 2, which may be in such a way conical that they become wider towards the final end of the machine. After the spiral screw 2, a shaping member, i.e. a cavity mandrel 3, is fitted. The apparatus is additionally provided with a deck plane 6 and with side boards 7 as well as with mix-levelling members 8, 9 and 10 placed at the top.

Each screw 2 is attached to a shaft 11, which can be driven by a motor 12. The shaft 11*a* extends through the screw up to the initial end of the cavity mandrel 3, and it can be driven by a motor 12*a*. The machine moves on a base 18 on wheels 19 in the direction indicated by the arrow.

In the embodiments of FIGS. 2 to 8, the mantle portion of the shaping members 3 is made of an elastic material, e.g. rubber.

Figure 3:
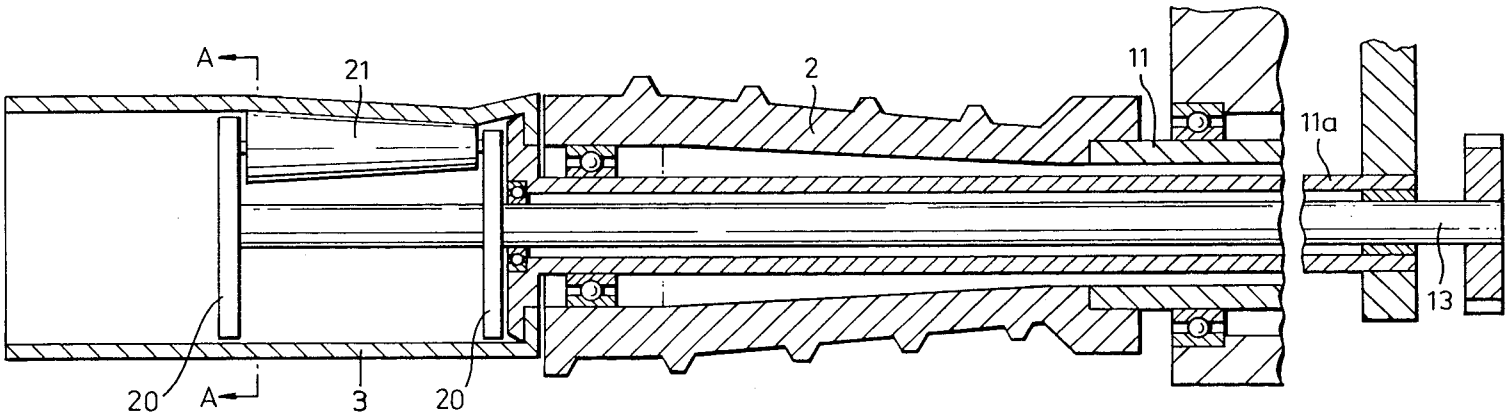
FIG. 3 depicts a detail of one embodiment on an enlarged scale.

In the embodiment of FIG. 3, the deformable, non-revolving shaping member 3 is supported on a stationary shaft 11*a*. Inside the flexible, elastic mantle 3 of the shaping member, a roll 21 of the shape of a truncated cone is fitted, which is attached between two support plates 20 and which revolves freely on its shaft. The roll 21 becomes wider towards the final end of the apparatus. The plates 20 are attached transversely stationarily to the shaft 13, which runs through the shaft 11*a* and which is provided with a drive of its own. The roll 21 is attached between the plates 20 as parallel to the drive shaft 13 far enough from the drive shaft so that its wider end extends the mantle of the shaping member 3 outwards at the roll. (The cross-sectional form of the mantle 3 of the shaping member is circular in the untensioned state). When the roll 21 circulates around the shaft 13, it deforms the mantle of the shaping member, and the concrete mix is compacted efficiently at the position of the roll.

Figure 3A:
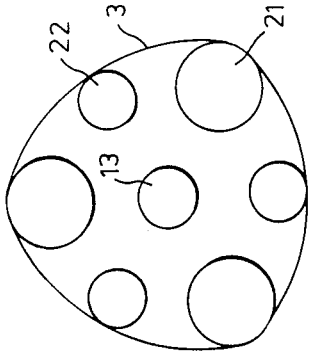
FIG. 3*a* is a view along the line A—A of FIG. 3 illustrating a modification of the embodiment shown in FIG. 3.

Instead of one roll 21, it is also possible to use several, e.g. three, rolls, which are attached between the plates 20 and are uniformly spaced around the shaft 13 (FIG. 3*a*). Thereby they make the final end of the mantle 3 change its shape to triangular form. If required, it is additionally possible to place smaller support rolls 22 between the conical rolls 21, which support rolls are placed closer to the shaft 13 so that they just support the mantle 3 without tensioning it.

The mantle 3 and the shaft 11*a* may also be revolving. It is also possible that the shaft 13 is non-revolving and the rolls 21 revolve only around their own shafts.

Figure 4:
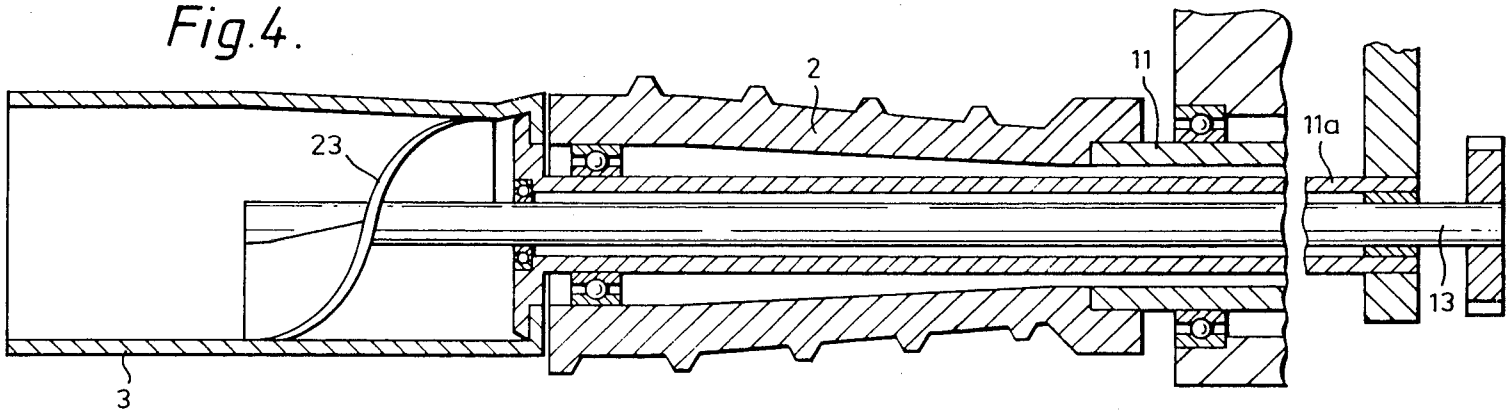
FIG. 4 depicts a detail of a second embodiment.

In the embodiment of FIG. 4, a plate 23 is fitted inside a flexible, elastic mantle 3, the plate 23 being attached to the drive shaft 13. A part of the edge of the plate runs in the shape of a screw line and covers 180° of the circumference of the mantle. The diameter of the screw is somewhat larger than the diameter of the inner face of the mantle 3 when the mantle is in the untensioned state, and the screw is slightly conical and becomes wider toward the end. The mantle 3 is non-revolving, and so is the shaft 11*a*. The spiral edge of the plate 23 may be provided with balls fitted in sockets. When the shaft 13 revolves, the screw spiral 23 extends one side of the mantle 3 further outwards and compacts the surrounding concrete mix and, at the same time, also carries the mix forwards. The balls fitted along the screw line reduce the friction between the spiral and the mantle.

The spiral may also have several flights. The portion of the mantle covered by it may also differ from 180°, but the spiral, however, preferably covers less than 360° of the circumference of the mantle. As is the case in the embodiment of FIG. 3, the mantle 3 and the shaft 13 may also be revolving.

Figure 5:
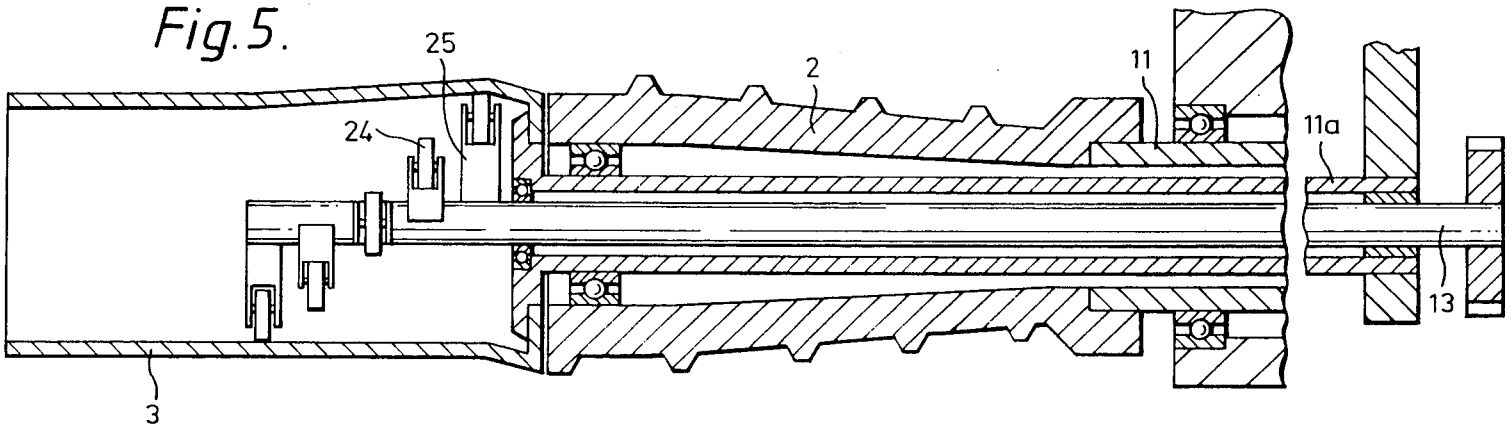
FIG. 5 depicts a detail of a third embodiment.

FIG. 5 shows a solution in which the spiral-shaped bent plate is substituted for by a screw-line shaped roll track consisting of rolls 24. The rolls 24 are supported on arms 25 projecting radially from the shaft 13. The roll track covers 180° of the circumference of the mantle.

The roll track may also have several flights. Likewise, the mantle 3 and the shaft 13 may be revolving.

Figure 6:
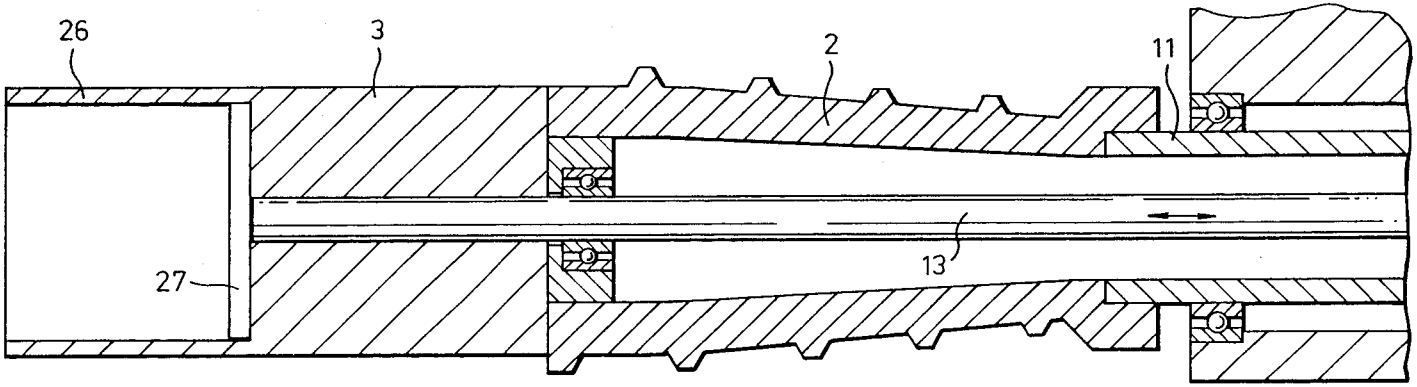
FIG. 6 depicts a detail of a fourth embodiment.

The shaping member 3 shown in FIG. 6 is, at one end, supported on a plate 27 attached to the shaft 13. The shaft 13 and the shaping member 3 may be either revolving or non-revolving. The shaft 13 can be moved back and forth in the axial direction. When the shaft 13 moves to the right in FIG. 6, it compresses the shaping member 3 so that the member is bulged at the middle and thereby compacts the surrounding concrete mix. When the shaft is returned, the shaping member also regains its original shape. It is also possible to push the shaft 13 beyond its original position so that the shaping member 3 becomes thinner than it was originally. After the shaping member 3, a follower tube 26 is fitted, which may be either resilient or rigid, e.g. a steel tube.

In the solution of FIG. 6, the deformation of the shaping member may also be produced by using a bellows as the shaping member, pressure shocks being applied to the interior of the bellows, or by means of leaf springs fitted inside the circumference of the shaping member in the axial direction, the leaf springs being bent by moving the shaft 13 axially back and forth.

The shape of the mantle can also be changed by inside the mantle moving one or several pieces of conical or other shape by means of the shaft 13, one portion of the said pieces projecting further outwards than the inside face of the mantle does in the rest state.

Figure 7:
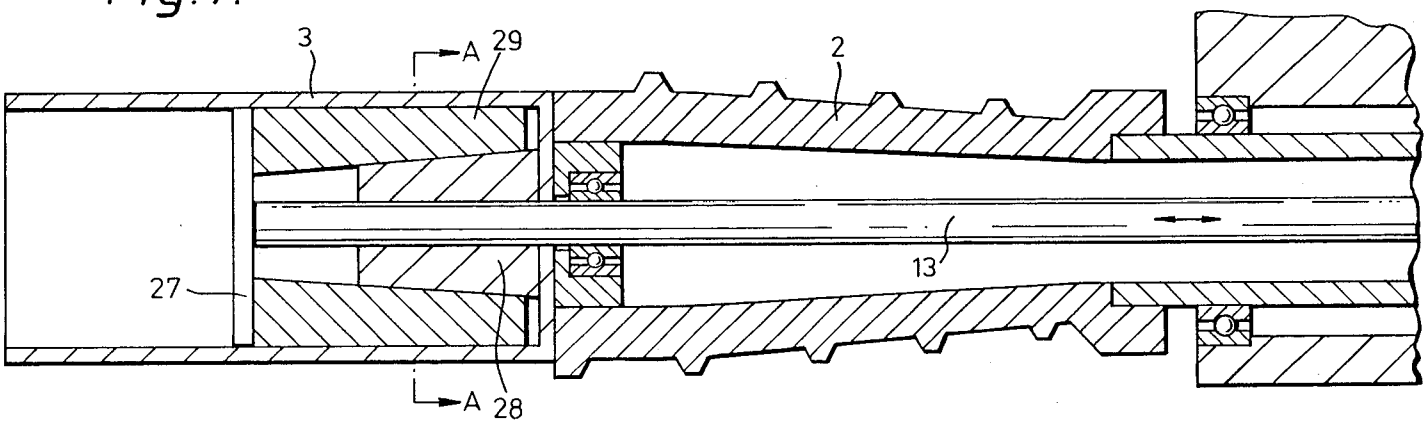
FIG. 7 illustrates a detail of a fifth embodiment.
Figure 7A:
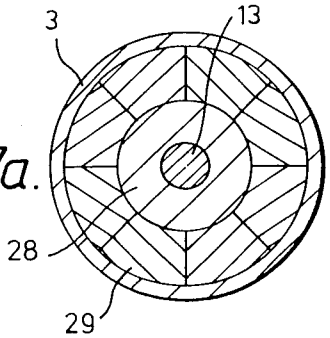
FIG. 7*a* is a sectional view along line A—A in FIG. 7.

FIGS. 7 and 7*a* show an embodiment in which a truncated cone 28 that becomes narrower towards the final end of the apparatus is attached to the end of the shaping member 3 next to the feeder screw 2, the shaft 13 passing through the said truncated cone 28. Around the cone 28, a sleeve 29 consisting of several sectors is fitted, whereat the inclination of the inside face of the sleeve 29 corresponds to the inclination of the cone 28. The final end of the sleeve 29 rests against the plate 27 at the final end of the shaft 10. When the shaft 13 moves to the right in the figure, the sleeve 29 becomes wider when it moves along the face of the cone 28, whereby the mantle 3 of the shaping member is extended and the cross-sectional area of the shaping member increases. In this way, the concrete mix surrounding the shaping member is compacted impulsively when the shaft 13 moves back and forth.

Figure 8:
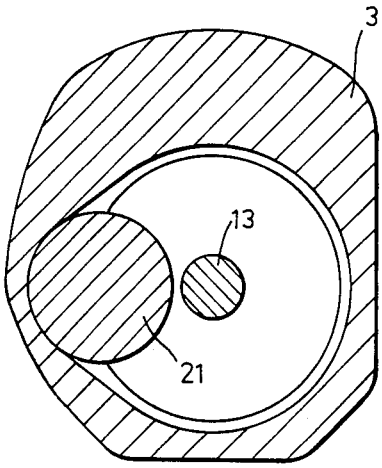
FIG. 8 is a cross-sectional view of a shaping member in accordance with one embodiment.

FIG. 8 shows a shaping member 3 of resilient material whose cross-sectional shape is not circular, but corresponds to the desired section of the cavity in the concrete slab. Inside the shaping member, there is a cone 21 in accordance with FIG. 3, which, when circulating around the shaft 13, extends the shaping member and compacts the concrete mix. In this embodiment, the mantle of the shaping member does not revolve around its longitudinal axis.

Figure 9:
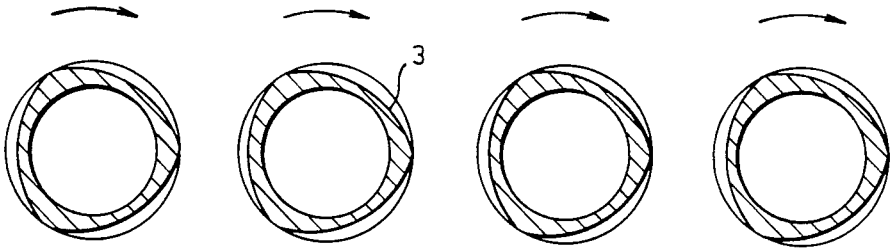
FIG. 9 is a cross-sectional view of shaping members in accordance with a second embodiment.
Figure 10A:
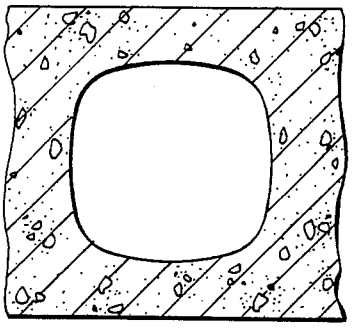
FIGS. 10*a* to 10*f* illustrate different cross-sectional shapes of a cavity that can be produced in accordance with the invention.
Figure 10B:
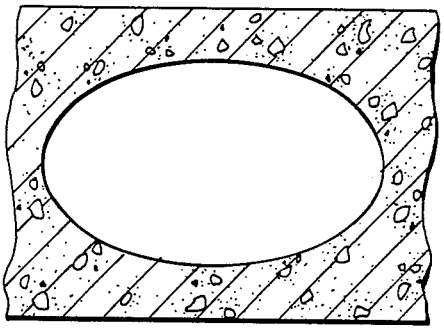
Figure 10C:
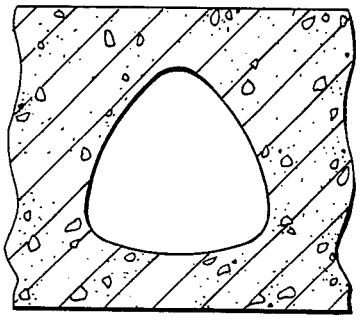
Figure 10D:
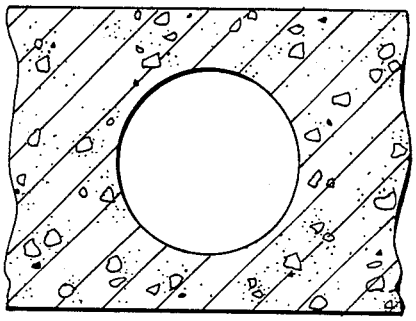
Figure 10E:
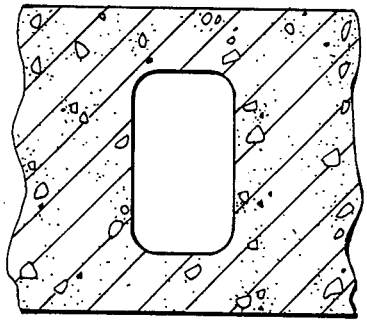
Figure 10F:
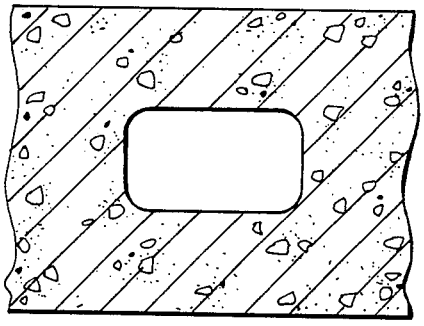

FIG. 9 is a sectional view of shaping members 3 placed side by side and having, e.g., a triangular section so that there are three cams uniformly spaced, the portions between the cams being of desired shape, e.g. convex. The number of the cams may also differ from three. The shaping members fitted side by side are fitted so that their cams corresponding to each other point at the same direction, as compared with each other, or are at a certain phase relative each other when the shaping members revolve at the same speed relative each other, either all of them in the same direction or in different directions. Thereby the cross-sectional shape of the space between two parallel shaping members is constantly changing. When the intermediate space is constantly deformed, the concrete mix contained therein is compacted.

FIGS. 10*a*–10*f* illustrate different cross-sectional forms of cavities, which are achieved by means of different embodiments of the invention.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A method for slide-casting hollow, precast units of concrete, comprising the steps of:

(a) extruding a concrete mix onto a base;

(b) forming a cavity in said concrete mix by moving at least one shaping member though the mix; and (c) compacting the mix by displacing the shaping member with respect to a longitudinal axis of the shaping member, said shaping member including a mantle portion having a shape that is changeable by varying the distance between the longitudinal axis of the shaping member and an outer surface of the mantle portion;

wherein the shape of said mantle portion is changed by movement of a support member supporting said mantle portion, said movement being in a direction parallel to the longitudinal axis of said shaping member.

2. A slide-casting apparatus for casting hollow, precast units of concrete, said apparatus comprising a deck plate having substantially opposed sidewalls, at least one shaping member having a longitudinal axis and a mantle portion and being displaceable along said deck plate for forming a cavity in a concrete mix, at least one feeding member for feeding concrete mix to said shaping member, a support member for supporting the mantle portion, and means for resiliently deforming said mantle portion to thereby compact and shape said concrete mix, said deforming means including means for moving said support member in a direction parallel to the longitudinal axis of the shaping member.

3. A slide-casting apparatus as claimed in claim 2, wherein the support member supports at least one end of the mantle portion.

4. A slide-casting apparatus as claimed in claim 3, wherein said mantle portion is constructed of elastic material, and wherein said means for deforming said mantle portion includes movement of said support member in a direction parallel to said longitudinal axis to alternatively apply and release compressive force on said shaping member, thereby causing said mantle portion to bulge at least at a middle portion thereof when said compressive force is applied, said bulge defining a first circumference, and causing said mantle portion to return to an unbulged state when said compressive force is released, thereby defining a second circumference smaller than said first circumference.

5. A slide-casting apparatus as claimed in claim 4, wherein said support member is secured to at least one end of said mantle portion, and wherein said means for deforming said mantle portion includes movement of said support member to a position resulting in said mantle portion having a third circumference less than said second circumference.

6. A slide-casting apparatus as claimed in claim 2, wherein said shaping member includes a bellows, and wherein said means for deforming said mantle portion includes application of pressure shocks to an interior of said bellows.

7. A slide-casting apparatus as claimed in claim 3, wherein said shaping member includes a plurality of leaf springs disposed within a circumference of said shaping member and parallel to said longitudinal axis of said shaping member, said leaf springs being bendable by movement of said support member.

8. A slide-casting apparatus as claimed in claim 2, wherein said means for deforming said mantle portion includes at least one piece fitted within said mantle portion and movable in a direction parallel to said longitudinal axis of said shaping member, at least a portion of said piece deforming said mantle portion at all times.

9. A slide-casting apparatus as claimed in claim 2, wherein said means for deforming said mantle portion includes a conical member disposed within said mantle portion, and a sleeve comprising a plurality of sectors, said sleeve being fitted over said conical member and having (a) an outer surface contacting said mantle portion and defining an outer diameter, (b) an inner surface slidably engaged with an outer surface of said conical member, and (c) an end surface engageable with said support member, whereby movement of said support member in said direction parallel to said longitudinal axis induces said sleeve to move relative to said conical member, thereby causing variations to said outer diameter of said sleeve, said mantle portion being deformed in accordance with said variations.

10. A slide-casting apparatus for casting hollow, precast units of concrete, said apparatus comprising a deck plate having substantially opposed sidewalls, a shaping member displaceable along said deck plate for forming a cavity in a concrete mix, and a feeding member for feeding the concrete mix to said shaping member, said shaping member including a resiliently deformable mantle portion for compacting and shaping the concrete mix;

wherein said mantle portion comprises a movable member mounted therein, movement of said movable member causing a change in cross-sectional shape of said mantle portion, and wherein said mantle portion surrounds a conical sleeve, said movable member being conically shaped and mounted for axial movement within said sleeve.

11. A slide-casting apparatus for casting hollow, precast units a concrete, said apparatus comprising a deck plate having substantially opposed sidewalls, a shaping member displaceable along said deck plate for forming a cavity in a concrete mix, and a feeding member for feeding the concrete mix to said shaping member, said shaping member including a resiliently deformable mantle portion for compacting and shaping the concrete mix;

wherein the mantle portion is rotatable around a longitudinal axis of the shaping member along an outer face of a support member mounted within the mantle portion, and wherein the support member mounted within the mantle portion is displaceable in a direction substantially parallel to the longitudinal axis of the shaping member.

* * * * *